US008606134B2

(12) United States Patent
Hibi et al.

(10) Patent No.: US 8,606,134 B2
(45) Date of Patent: Dec. 10, 2013

(54) IMAGE FORMING APPARATUS

(75) Inventors: Yoshitaka Hibi, Mishima (JP); Hironobu Nihei, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 296 days.

(21) Appl. No.: 13/210,098

(22) Filed: Aug. 15, 2011

(65) Prior Publication Data

US 2012/0045232 A1 Feb. 23, 2012

(30) Foreign Application Priority Data

Aug. 20, 2010 (JP) ..... 2010-185088

(51) Int. Cl.
*G03G 15/16* (2006.01)

(52) U.S. Cl.
USPC ..... 399/66; 399/121; 399/297; 399/154

(58) Field of Classification Search
USPC ..... 399/66, 121, 297, 154
See application file for complete search history.

(56) References Cited

U.S. PATENT DOCUMENTS

| | | | | |
|---|---|---|---|---|
| 6,336,025 | B1 * | 1/2002 | Saeki | 399/301 |
| 2001/0022907 | A1 | 9/2001 | Fukao et al. | |
| 2007/0144362 | A1 | 6/2007 | Takata et al. | |
| 2008/0292339 | A1 * | 11/2008 | Itagaki | 399/49 |

FOREIGN PATENT DOCUMENTS

| | | | |
|---|---|---|---|
| JP | 2000-295882 | A | 10/2000 |
| JP | 2001-201994 | A | 7/2001 |
| JP | 2001-343878 | A | 12/2001 |
| JP | 2002-174957 | A | 6/2002 |
| JP | 2005-250492 | A | 9/2005 |
| JP | 2007-004048 | A | 1/2007 |
| JP | 2007-024996 | A | 2/2007 |

* cited by examiner

*Primary Examiner* — Walter L Lindsay, Jr.
*Assistant Examiner* — Roy Y Yi
(74) *Attorney, Agent, or Firm* — Canon USA Inc. IP Division

(57) ABSTRACT

An image forming apparatus stops the intermediate transfer belt so that a wrinkle is formed at a predetermined position of an intermediate transfer belt and, by detecting a reference mark during a preparation operation for forming an image when starting image formation, the toner image is not transferred onto the wrinkle formed in the intermediate transfer belt when formation of a toner image is started immediately after the preparation operation has been completed.

6 Claims, 17 Drawing Sheets

IMAGE FORMING APPARATUS

BACKGROUND OF THE INVENTION

1. Field of the Invention

The present invention relates to an image forming apparatus, such as an electrophotographic copier, printer, or facsimile, and, in particular, to an image forming apparatus including an intermediate transfer member onto which an image is transferred.

2. Description of the Related Art

Some existing image forming apparatuses include an intermediate transfer belt serving as an intermediate transfer member onto which a toner image formed on a photosensitive drum is transferred. In such image forming apparatuses, in order to control driving of an intermediate transfer belt, a reference mark formed of a light reflecting member is provided on the intermediate transfer belt. In addition, a detection sensor for optically detecting the reference mark is provided.

In order to form an image, such an image forming apparatus performs control so as to start an image forming process after a preset period of time has elapsed since the reference mark was detected by a detection sensor and transfer a toner image onto an intermediate transfer belt at a predetermined position. In addition, when the image forming process is completed, the image forming apparatus performs control so as to stop the intermediate transfer belt after a preset period of time has elapsed since the reference mark was detected by a detection sensor. Thus, the intermediate transfer belt stops at the same position. This is to make a first printout time (hereinafter also referred to as an "FPOT") constant.

Since the intermediate transfer belt is held tight around a plurality of support rollers, partial wrinkle of the intermediate transfer belt may occur at a position at which the intermediate transfer belt is in contact with the support roller if, as described above, the intermediate transfer belt stops at the same position. If a wrinkle occurs, a toner image transferred onto the intermediate transfer member cannot be transferred onto a recording material at an accurate position. Accordingly, an image defect, such as white streaking, may occur. To address such an issue, Japanese Patent Laid-Open No. 2001-201994 describes a technique for reducing the probability of the occurrence of such an image defect caused by a wrinkle of an intermediate transfer belt by performing control so that the intermediate transfer belt stops at least two different positions.

If, as described in Japanese Patent Laid-Open No. 2001-201994, the intermediate transfer belt is stopped at least two different positions, the occurrence of an image defect caused by a wrinkle can be reduced. However, the position at which the intermediate transfer belt is stopped is not determined in consideration of a first printout time. Therefore, in some cases, an optimum first printout time cannot be realized depending on a stop position.

SUMMARY OF THE INVENTION

The present invention provides an image forming apparatus capable of realizing an optimum first printout time while reducing or eliminating the occurrence of an image defect caused by a wrinkle.

According to an aspect of the present invention, an image forming apparatus includes an image bearing member, a developing unit configured to develop a latent image formed on the image bearing member into a toner image, an intermediate transfer member, a transfer unit configured to transfer the toner image formed on the image bearing member onto the intermediate transfer member at a transfer portion, a tension member configured to support the intermediate transfer member, where an imprint portion of the intermediate transfer member is formed by the tension member, a reference mark marked on the intermediate transfer member and used for controlling the position of the intermediate transfer member, a detecting unit configured to detect the reference mark marked on the intermediate transfer member, a preparation unit configured to perform an initial operation when the image forming apparatus is started in order to form the toner image using the developing unit, and a control unit configured to control the transfer unit. During an initial operation performed by the preparation unit, the detecting unit detects the reference mark. The control unit performs control so that transfer of the toner image is started at a point in time after the initial operation has been completed and the reference mark has been detected during the initial operation and at which a predetermined period of time has elapsed since the reference mark was detected, where the predetermined period of time is set so that the point in time is before the reference mark is detected again after the intermediate transfer member has rotated one revolution and is after the imprint portion has passed through the transfer portion, and the transfer of the toner image ends before the imprint portion passes through the transfer portion again.

Further features of the present invention will become apparent from the following description of exemplary embodiments with reference to the attached drawings.

DESCRIPTION OF THE EMBODIMENTS

First Embodiment

Embodiments of the present invention are described below with reference to the accompanying drawings. Note that the following embodiments should not be construed as restricting the sprit or scope of the invention described in the attached claims in any way, and not all combinations of features described in the embodiments of the present invention are indispensable for solving means of the present invention.

Image Forming Operation Performed by Image Forming Apparatus

Figure 1:
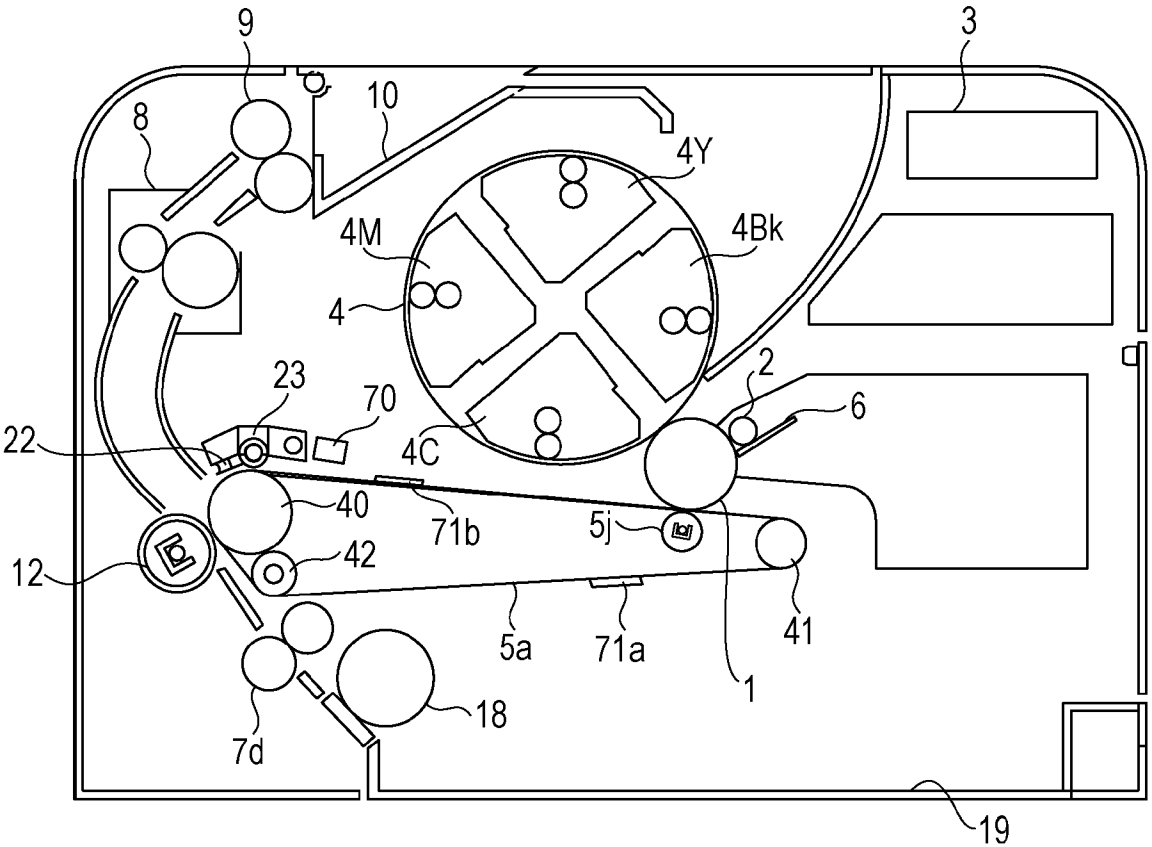
FIG. 1 is a schematic illustration of the configuration of an image forming apparatus.

FIG. 1 is a schematic illustration of an exemplary configuration of a laser printer, which is an example of an image forming apparatus. The image forming operation performed by the image forming apparatus is described below. An intermediate transfer belt 5*a* serving as the intermediate transfer member is held tight around a driving roller 40, a first driven roller (a tension roller) 41, and a second driven roller (an idler roller) 42 serving as a tension member. The intermediate transfer belt 5*a* is rotated in synchronization with the rotation of a photosensitive drum 1 serving as an image bearing member. The surface of the photosensitive drum 1 is uniformly charged by a charging unit 2. Exposure for a yellow (Y) image is performed by an exposure unit 3 so that a Y electrostatic latent image is formed on the photosensitive drum 1 (the image bearing member). At the same time as the electrostatic latent image is formed, a rotary developing apparatus 4 is driven, and a Y developing unit 4Y is moved to a development position. Driving force is transferred to the Y developing unit 4Y moved to the development position by a development coupling (not shown). Thus, the Y developing unit 4Y is rotated. The Y developing unit 4Y applies, to Y toner, a voltage having a polarity that is the same as the polarity of charge on the photosensitive drum 1 and a level that is substantially the same as that of the charge on the photosensitive drum 1. Thus, Y toner serving as a developer is deposited to the electrostatic latent image, and the toner image is developed. Thereafter, a voltage having a polarity that is opposite to the polarity of the toner image is applied to a primary transfer roller 5*j* disposed inside the intermediate transfer belt 5*a*. Thus, the toner image on the photosensitive drum 1 is primarily transferred onto the intermediate transfer belt 5*a*.

After primary transfer of the Y toner image is completed, the rotary developing apparatus 4 is driven so that a developing unit for the next color is moved to the development position. As in the case for Y, toner images for magenta (M), cyan (C), and black (Bk) are sequentially formed, and the toner images of the four colors are overlaid on one another on the intermediate transfer belt 5*a*. Note that the position of the rotary developing apparatus 4 is detected by a rotary position detection sensor and is controlled. In addition, while primary transfer of each of the colors is being performed, a secondary transfer roller 12 is located at a position at which the secondary transfer roller 12 is not in contact with the intermediate transfer belt 5*a*. Similarly, a charging brush 22 and a charging roller 23 that serve as a cleaning unit are located at positions at which the charging brush 22 and the charging roller 23 are not in contact with the intermediate transfer belt 5*a*.

After the toner images of four colors have been formed on the intermediate transfer belt 5*a* (the intermediate transfer member), the secondary transfer roller 12 is brought into contact with the intermediate transfer belt 5*a*. Thus, a secondary transfer unit is formed. In synchronization with timing at which an image formed on the intermediate transfer belt 5*a* is conveyed to the secondary transfer unit, a sheet is fed from a stacking unit 19 using a pickup roller 18. Thus, the recording material located at a predetermined standby position is conveyed to the secondary transfer unit by using a pair of conveying rollers 7*d* serving as a sheet re-feed unit. Since a voltage having a polarity opposite to that of the toner is applied to the secondary transfer roller 12, the toner images on the intermediate transfer belt 5*a* are secondarily transferred onto the surface of the conveyed recording material.

The recording material having the images secondarily transferred thereonto is conveyed to a fusing unit 8, which fuses the images. Thereafter, the recording material is output to a paper output tray 10 by a pair of eject rollers 9. In this way, image formation is completed.

Intermediate Transfer Belt Unit and Photosensitive Drum Unit

Figure 2:
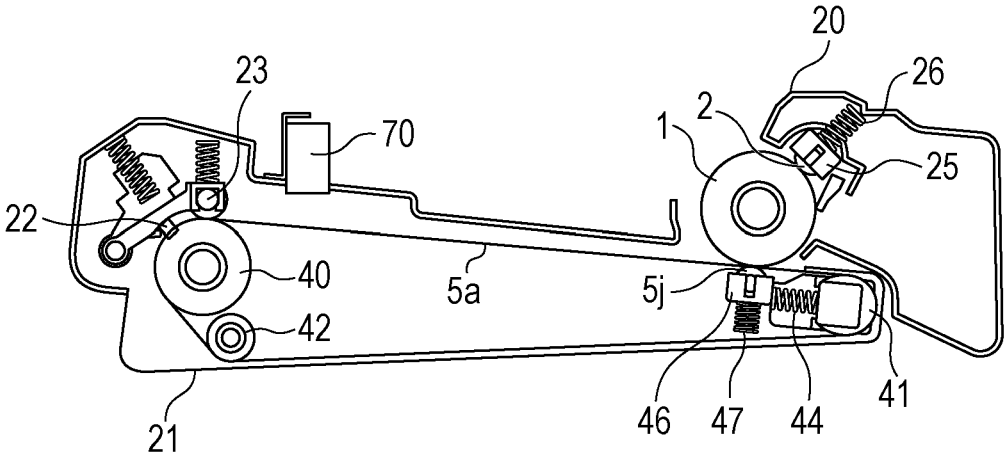
FIG. 2 is a cross-sectional view of an intermediate transfer belt unit and a photosensitive drum unit.
Figure 3:
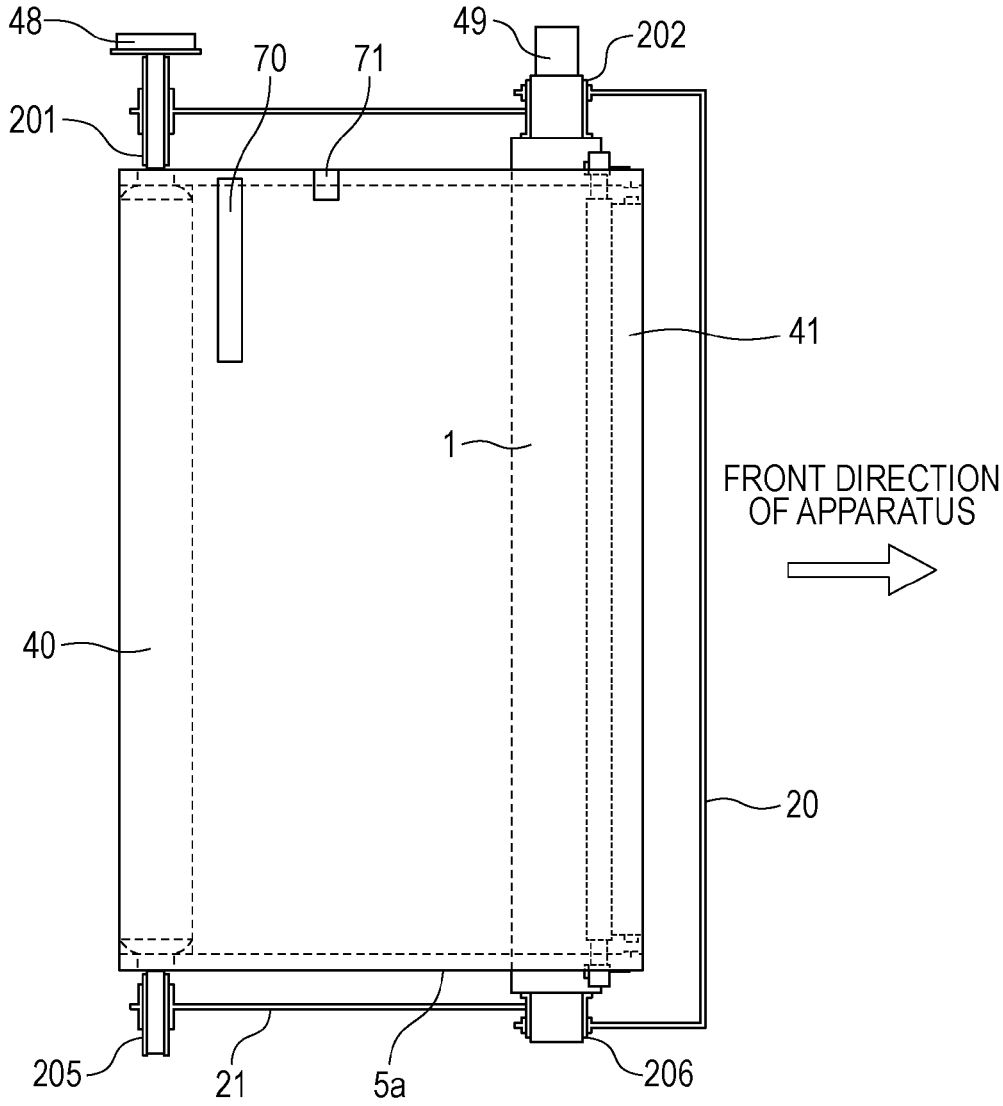
FIG. 3 is a transverse cross section of the intermediate transfer belt unit and the photosensitive drum unit.

FIG. 2 is a cross-sectional view of an intermediate transfer belt unit 21 and a photosensitive drum 20. FIG. 3 is a cross-sectional view of the intermediate transfer belt unit 21 and the photosensitive drum 20 when viewed from above. The intermediate transfer belt unit 21 and the photosensitive drum 20 are described below.

The photosensitive drum 20 is described first. Two ends of the photosensitive drum 1 are rotatably supported by a right bearing 202 and a left bearing 206. A predetermined rotational driving force is transferred from the image forming apparatus to the right end of the photosensitive drum 20 via a coupling 49. In addition, the charging unit 2 is in contact with the photosensitive drum 1 with a predetermined pressure via bearings 25 at either end of the charging unit 2 using a compression spring 26. Thus, the charging unit 2 is rotated upon rotation of the photosensitive drum 1.

The intermediate transfer belt unit 21 is described next. The intermediate transfer belt 5*a* is held in tension around the driving roller 40, the first driven roller (tension roller) 41, and the second driven roller (idler roller) 42. Note that according to the present embodiment, the length of the intermediate transfer belt 5*a* is greater than a maximum length of an image formable by the image forming apparatus in the length direction and is less than double the maximum length of the image formable by the image forming apparatus in the length direction. The ends of the driving roller 40 are rotatably supported by a right bearing 201 and a left bearing 205. A predetermined rotational driving force is transferred from the image forming apparatus to the driving roller 40 via a drive gear 48 disposed in a right bearing unit. The bearings at both ends of the first driven roller 41 have a compression spring 44. Thus, predetermined tension is applied to the intermediate transfer belt 5*a*. The primary transfer roller 5*j* is located on the opposite side of the intermediate transfer belt 5*a* from the photosensitive drum 1. The primary transfer roller 5*j* is in pressure contact with the intermediate transfer belt 5*a* with a compression spring 47 via bearings 46 provided on both ends of the primary transfer roller 5*j*. Thus, the primary transfer roller 5*j* is rotated upon rotation of the intermediate transfer belt 5*a*. At least one of the bearings is formed from a conductive member. By applying a predetermined bias to the primary transfer roller 5*j*, toner on the photosensitive drum 1 can be primarily transferred onto the intermediate transfer belt 5*a*.

In order to detect the position of the intermediate transfer belt 5*a* in the conveying direction and control registration of toner images of individual colors that are overlaid on the intermediate transfer belt 5*a*, an optical detection sensor (photosensor) 70 and a reference mark 71 that serve as a position detecting unit are provided for the intermediate transfer belt 5*a*. The reference mark 71 is placed outside the area in which an image is formed in the width direction of the intermediate transfer belt 5*a*. The reflective optical detection sensor 70 is disposed at a predetermined position so as to face the reference mark 71. By detecting light reflected by the reference mark 71, the image forming apparatus controls the position of the intermediate transfer belt 5*a* in the conveying direction, the position at which an image is written, and the timing at which image data is written onto the photosensitive drum 1 by an exposure unit 3.

Figure 4:
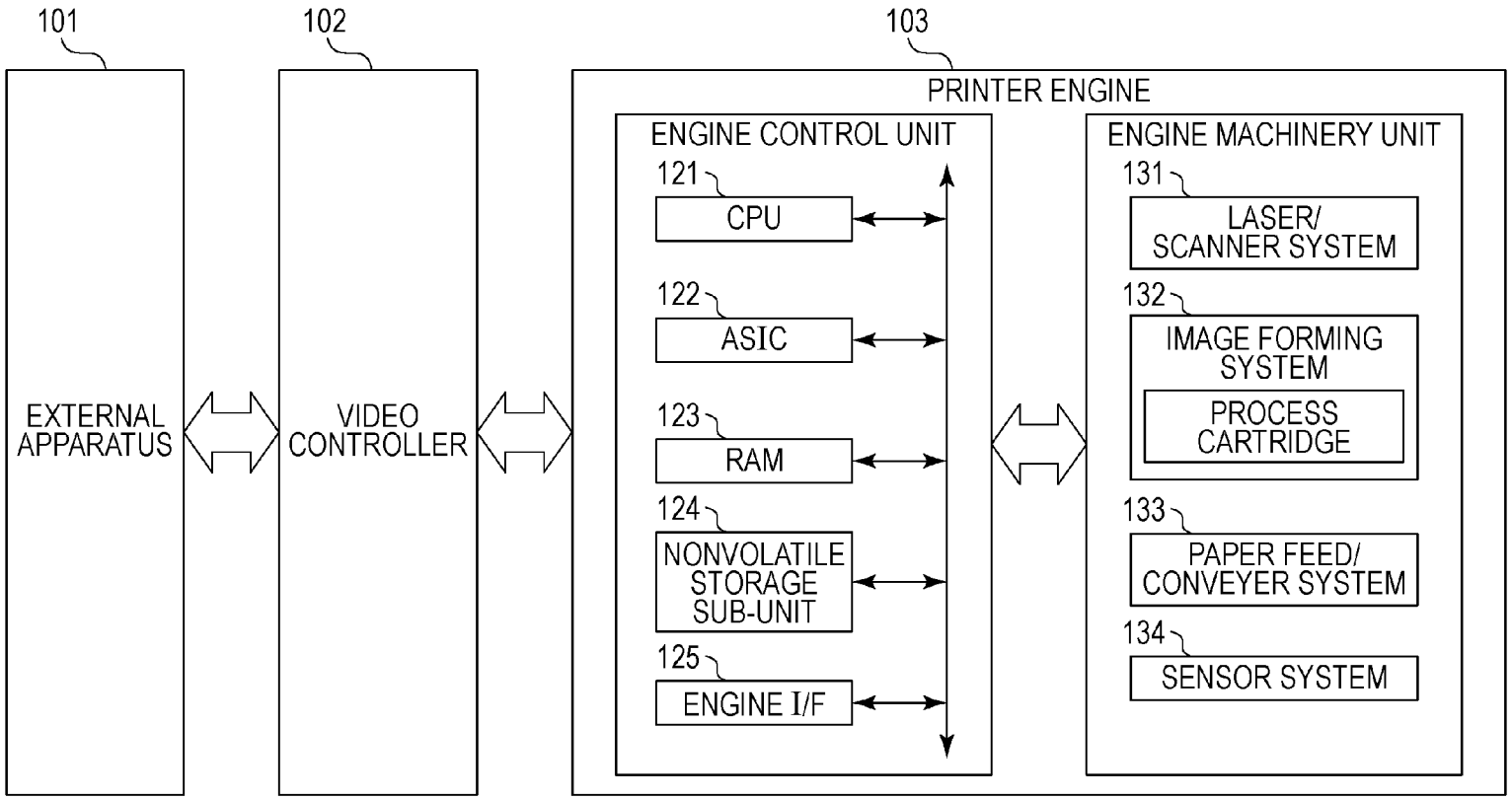
FIG. 4 is a hardware block diagram illustrating the system configuration of the image forming apparatus.

FIG. 4 is a block diagram of the hardware illustrating the system configuration of the image forming apparatus. An external apparatus 101, a video controller 102, and a printer engine 103 are shown in FIG. 4.

The printer engine 103 is described in detail below. The printer engine 103 includes an engine control unit and an engine machinery unit. The engine machinery unit operates under the control of the engine control unit. The engine machinery unit is described in detail first, and, subsequently, the engine control unit is described in detail.

A laser/scanner system 131 includes a laser-emitting element, a laser driver circuit, a scanner motor, a rotatable polygon mirror, and a scanner driver. The laser/scanner system 131 forms a latent image on the photosensitive drum 1 by a laser beam scanning the photosensitive drum 1 for exposure in accordance with image data transmitted from the video controller 102. An image forming system 132 plays a main role of the image forming apparatus. The image forming system 132 forms a toner image on a recording material on the basis of the latent image formed on the photosensitive drum. The image forming system 132 includes process elements, such as a process cartridge, the intermediate transfer belt 5*a*, and the fusing unit 8, and a high-voltage power supply circuit that generates a variety of biases (high voltages) required for forming an image. The process cartridge includes a discharging unit, an electrical charging roller, a developing roller, and a photosensitive drum. The process cartridge further includes a nonvolatile memory tag. A central processing unit (CPU) 121 or an application specific integrated circuit (ASIC) 122 reads and writes a variety of types of information from and to the memory tag.

A paper feed/conveyer system 133 controls feeding of a recording material and conveying of the recording material. The paper feed/conveyer system 133 includes a variety of conveyer motors, paper feed and output trays, and a variety of conveying rollers. A sensor system 134 is formed from a sensor group of sensors for collecting information required for control performed by the CPU 121 and the ASIC 122 (described in more detail below). The sensor group includes at least widely used sensors, such as a temperature sensor for the fusing unit 8, a toner level sensor, a color density sensor for detecting the color density of an image, a sheet size sensor, a sheet leading edge detecting sensor, and a sheet conveyance detecting sensor. Information detected by such sensors is acquired by the CPU 121 and is used for print sequence control. Note that in FIG. 4, the sensor system 134 is separated from the laser/scanner system 131, the image forming system 132, and the paper feed/conveyer system 133. However, the sensor system 134 may be integrated into one of the other systems.

The engine control unit is described next. The CPU 121 controls the engine machinery unit in accordance with a variety of control programs stored in a nonvolatile storage subunit 124 using a RAM 123 as a main memory and a work area. More specifically, the CPU 121 drives the laser/scanner system 131 on the basis of a print control command and image data input from the video controller 102 via an engine interface 125. In addition, the CPU 121 controls a variety of print sequences by controlling the image forming system 132 and the paper feed/conveyer system 133. Furthermore, the CPU 121 acquires information required for controlling the image forming system 132 and the paper feed/conveyer system 133 by driving the sensor system 134. In contrast, under the control of the CPU 121, the ASIC 122 controls a variety of motors used for executing the above-described variety of print sequences and high voltages, such as a development bias. Note that some or all of the functions of the CPU 121 may be performed by the ASIC 122. Alternatively, some or all of the functions of the ASIC 122 may be performed by the CPU 121. Still alternatively, some of the functions of the CPU 121 and the ASIC 122 may be performed by newly provided dedicated hardware.

Figure 5A:
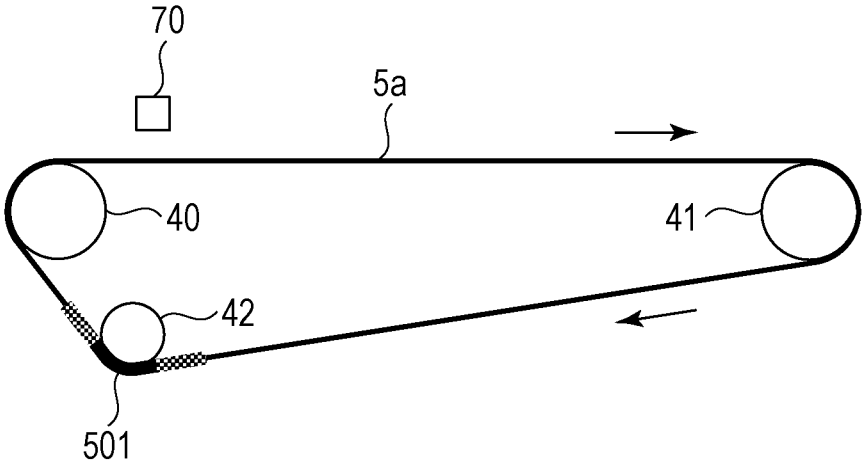
FIGS. 5A and 5B illustrate a wrinkle formed in an intermediate transfer belt, an area in which the wrinkle is formed, and an area in which a toner image is formed.

FIG. 5A illustrates a wrinkle occurring in the intermediate transfer belt 5*a* due to contact of the intermediate transfer belt 5*a* with the second driven roller 42. Note that the wrinkle is formed as an imprint portion. As used herein, the term "imprint portion" refers to a portion of the intermediate transfer belt 5*a* that is locally deformed by the second driven roller 42. If the intermediate transfer belt 5*a* stops at the same position, a wrinkle 501 due to the second driven roller (support roller) 42 occurs in a portion that is in contact with the support roller 42 over time. Note that it is difficult for the intermediate transfer belt 5*a* to stop at the same position and, thus, the stop position slightly varies. Therefore, in reality, the wrinkle 501 is a set of wrinkles occurring at a plurality of positions. Accordingly, the wrinkle 501 represents wrinkles occurring in a region after taking into account variation in the positions at which an intermediate transfer belt drive motor stops (the right and left areas of the wrinkle 501 shown in FIG. 5A).

Figure 5B:
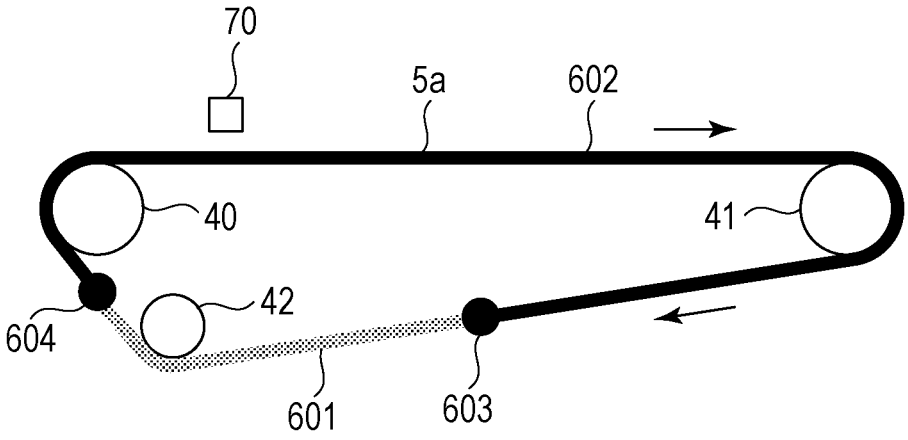

FIG. 5B illustrates a region in which a wrinkle, which is an area into which a toner image is not intended to be transferred, is formed and a region in which a toner image is formed. According to the embodiment, for example, the circumferential length of the intermediate transfer belt 5*a* is 377 mm, and the sheet size (an image size) that is most frequently used is A4 (a width of 210 mm and a length of 297 mm). Then, control is performed so that an image is formed without using a wrinkle portion. That is, the length of an area 602 into which a toner image is transferred is 297 mm. The length of an area 601 into which a toner image is not transferred is 80 mm (=377−297 mm). A leading edge 603 and a trailing edge 604 of the area 602 into which a toner image is transferred are also shown. Note that for ease of description, the circumferential length of the intermediate transfer belt 5*a* is set to 377 mm, and the image size is set to A4. However, if the circumferential length of the intermediate transfer belt 5*a* allows a wrinkle to be formed in the area 601 into which a toner image is not transferred, any circumferential length and image size can be employed.

Figure 6A:
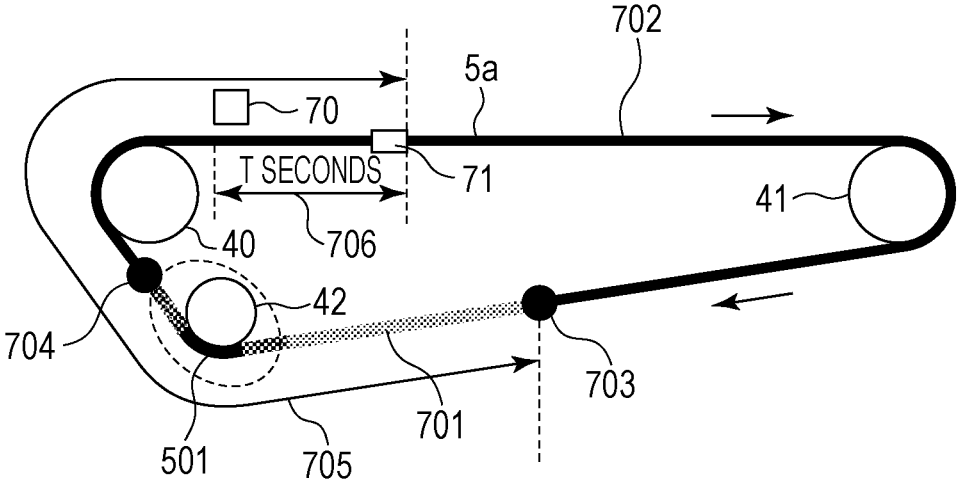
FIGS. 6A and 6B illustrate the position at which an intermediate transfer belt is stopped and the transfer timing.

FIG. 6A illustrates a technique for controlling a position at which the intermediate transfer belt 5*a* stops. After image formation has been completed, the intermediate transfer belt 5*a* is stopped after a predetermined period of time has elapsed since the detection sensor 70 detected the reference mark 71. Thus, since the position at which the intermediate transfer belt 5*a* is stopped can be set to be the same, the position of the wrinkle 501 formed in the intermediate transfer belt 5*a* can be within the area in which a toner image is not transferred.

According to the present embodiment, when the intermediate transfer belt 5*a* is stopped, the intermediate transfer belt 5*a* is stopped after T seconds have elapsed since the detection sensor 70 detected the reference mark 71. The value of T is determined so that a wrinkle is formed in the intermediate transfer belt 5*a* at a predetermined position. In addition, when image formation is started, the intermediate transfer belt 5*a* is started. Subsequently, in order to realize an optimum FPOT, control is performed so that, when transfer of a toner image to the intermediate transfer belt 5*a* is started after the detection sensor 70 detects the reference mark 71, the toner image does not overlap a wrinkle. In this way, an optimum FPOT can be realized by reducing a negative impact of a wrinkle on a toner image. Note that the value of T (sec) can be appropriately determined in accordance with the conditions, such as the circumferential length of the intermediate transfer belt 5*a*, the driving speed of the intermediate transfer belt 5*a*, and a maximum size of the formed image.

Figure 6B:
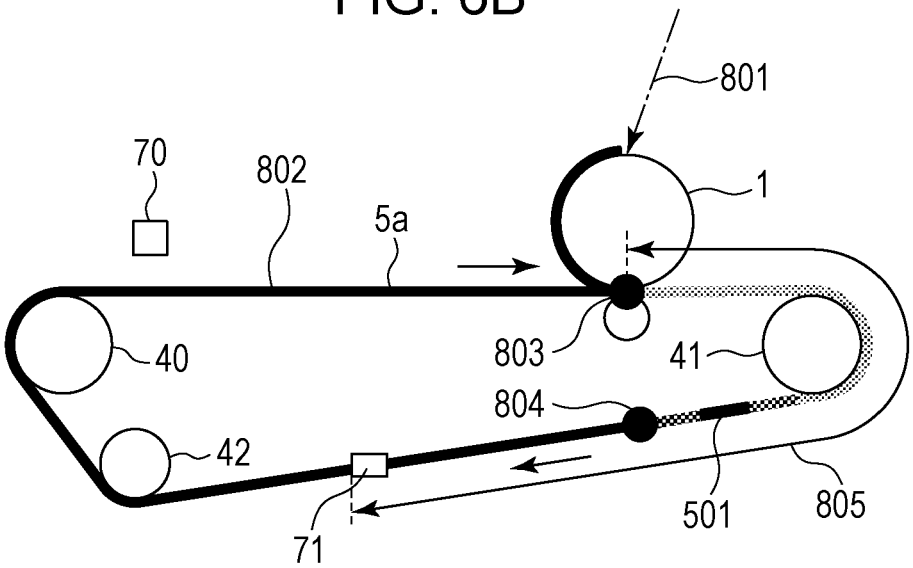

FIG. 6B illustrates transfer timing employed when a toner image is transferred while avoiding an area including the wrinkle 501 into which a toner image is not intended to be transferred. As illustrated in FIG. 6A, control is performed so that the distance between the reference mark 71 and the area in which a wrinkle is formed and, thus, a toner image is not intended to be formed is constant. Accordingly, in order to transfer a toner image while avoiding the wrinkle of the intermediate transfer belt 5*a*, control is performed so that transfer of a toner image is started after the area in which a wrinkle is formed and, thus, a toner image is not intended to be formed passes through a transfer nip. In addition, by setting the timing of transfer of a toner image to the point in time immediately after a preparation operation, which is an initial operation for image formation, is completed, downtime between completion of the preparation operation and transfer of a toner image does not occur. Therefore, an optimum FPOT can be realized. Note that a relationship between the timing at which a preparation operation is completed and the timing at which transfer is started is described in more detail below with reference to a timing diagram. In addition, a wrinkle need not be avoided for all of the image sizes. For example, when the intermediate transfer belt 5*a* is used under the above-described conditions and if a toner image having a legal size (the length is 355.6 mm) is transferred, transfer can be started at the same timing as for a toner image having an A4 size so that the trailing edge of the toner image overlaps the wrinkle. In such a case, although the trailing edge of the toner image may have a slight negative impact, an optimum FPOT can be realized.

Figure 7:
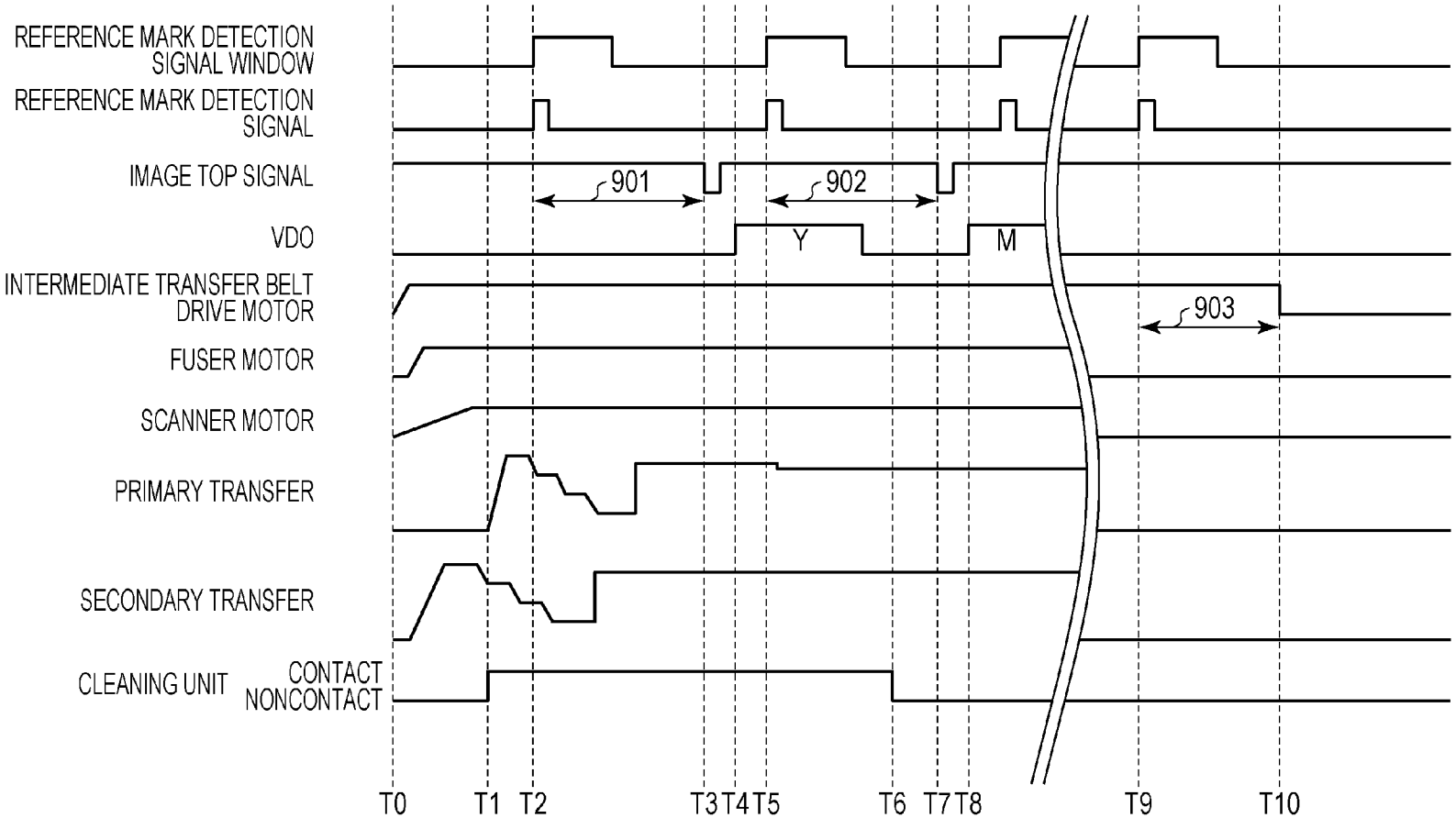
FIG. 7 is a timing diagram illustrating a preparation operation and transfer timing.

FIG. 7 is a timing diagram indicating the preparation operations and transfer timing when an image is formed. A technique for realizing an optimum FPOT while reducing a negative impact of a wrinkle on a toner image is described next with reference to the timing diagram shown in FIG. 7.

Upon receiving an image formation command, the CPU 121 starts a preparation operation before starting an image forming operation. The preparation operation includes driving a variety of actuators, such as an intermediate transfer belt drive motor, a fuser motor, and a scanner motor, controlling adjustment of a secondary transfer bias, and applying a variety of high voltages (T0). When starting the scanner motor, a laser beam is forcibly emitted. Thus, a voltage difference is generated in the surface of the photosensitive drum 1. If, at that time, primary transfer control is performed, the primary transfer cannot be sufficiently controlled. Accordingly, primary transfer is started after the voltage difference disappears (T1). In addition, after adjustment of secondary transfer bias is completed, a cleaning unit is brought into contact with the intermediate transfer belt 5*a*. Thus, cleaning of the intermediate transfer belt 5*a* is performed until image formation is started. Note that cleaning of the intermediate transfer belt 5*a* using the cleaning unit in contact therewith is performed only in a preparation operation for a first page. A cleaning operation is not performed for pages subsequent to a second page in continuous page printing. In addition, although the period of time required for the preparation operation slightly varies from time to time, the preparation operation is completed within a period of time from T0 to T3.

At the same time as the preparation operation, in order to detect the reference mark 71 using the detection sensor 70, a monitoring operation for a reference mark is started. Hereinafter, a period of time during which the reference mark 71 is monitored using the detection sensor 70 is referred to as a "reference mark detection window". Start of the monitoring operation is referred to as "window open", and completion of the monitoring operation is referred to as "window close". In order to start monitoring a reference mark, a reference mark detection window is opened, and detection continues until the detection sensor 70 detects the reference mark 71. Note that in order to detect a reference mark 71 immediately after the reference mark detection window has been opened, the position at which the intermediate transfer belt 5*a* stops is determined using the distance between the reference mark 71 and the trailing edge of an area into which a toner image is not intended to be transferred and the period of time required for the preparation operation. Accordingly, an image can be formed with an optimum FPOT without downtime after the preparation operation is completed. After the detection sensor 70 detects the reference mark 71 (T2) and a time 901 during which the intermediate transfer belt 5*a* is driven until the trailing edge of an area including the wrinkle into which a toner image is not intended to be transferred passes through the transfer nip elapses, the CPU 121 outputs an image TOP signal to the video controller 102 (T3). Note that this point in time is determined so as to be within a period of time from when the reference mark 71 is detected by the detection sensor 70 to when the reference mark 71 is detected by the detection sensor 70 again. By determining the point in time in this manner, image formation can be performed immediately after the preparation operation is completed. Thus, the FPOT can be optimized. Thereafter, the CPU 121 receives a VDO signal (a video signal) from the video controller 102 and starts formation of a Y toner image (T4). The Y toner image formed on the photosensitive drum 1 is transferred onto the intermediate transfer belt 5*a* from the trailing edge of an area into which a toner image is not intended to be transferred. Subsequently, the cleaning unit is moved away from the intermediate transfer belt 5*a* before the Y toner image reaches the cleaning unit (T6).

During formation of the Y toner image, a reference mark detection window for a second revolution is opened. As in formation of the Y toner image, if the detection sensor 70 detects the reference mark 71 (T5) and a time 902 during which the intermediate transfer belt 5*a* is driven until the trailing edge of an area including the wrinkle into which a toner image is not intended to be transferred passes through the transfer nip elapses, the CPU 121 outputs an image TOP signal to the video controller 102 (T7). Thereafter, the CPU 121 receives a VDO signal from the video controller 102 and starts formation of an M toner image (T8). Subsequently, a C toner image and a Bk toner image are formed in a similar manner. In this way, a color image is formed on the intermediate transfer belt 5*a*.

As described above, an image is formed by driving the intermediate transfer belt 5*a*. The point is that the reference mark 71 is detected during an image formation preparation operation. That is, the reference mark detection window is opened after {(the circumferential length of the intermediate transfer belt 5*a*÷the process speed)−T(s)−(the start margin of the intermediate transfer belt 5*a* drive motor)} seconds have elapsed since an image formation operation was started. In this way, control can be performed so that a toner image is not transferred into an area of the intermediate transfer belt 5*a* including a wrinkle in which a toner image is not intended to be transferred when image formation is started immediately after a preparation operation is completed. As a result, an optimum FPOT can be realized while reducing a negative impact of the wrinkle on the toner image.

An operation for stopping the intermediate transfer belt 5*a* after an image forming operation has been completed is described next. If preparation for stopping the intermediate transfer belt 5*a* is completed, a reference mark detection window is opened. The CPU 121 waits until the detection sensor 70 detects the reference mark 71. If the reference mark 71 is detected (T9), the intermediate transfer belt 5*a* is stopped after a predetermined time 903 has elapsed so that a wrinkle is formed at a predetermined position and an optimum FPOT is realized (T10). Note that the time 903 is determined so that the toner image is not transferred into an area of the intermediate transfer belt 5*a* in which a toner image is not intended to be transferred using the position of the wrinkle, the period of time required for a preparation operation, and the driving speed of the intermediate transfer belt 5*a*. In this way, an optimum FPOT is realized.

Figure 8:
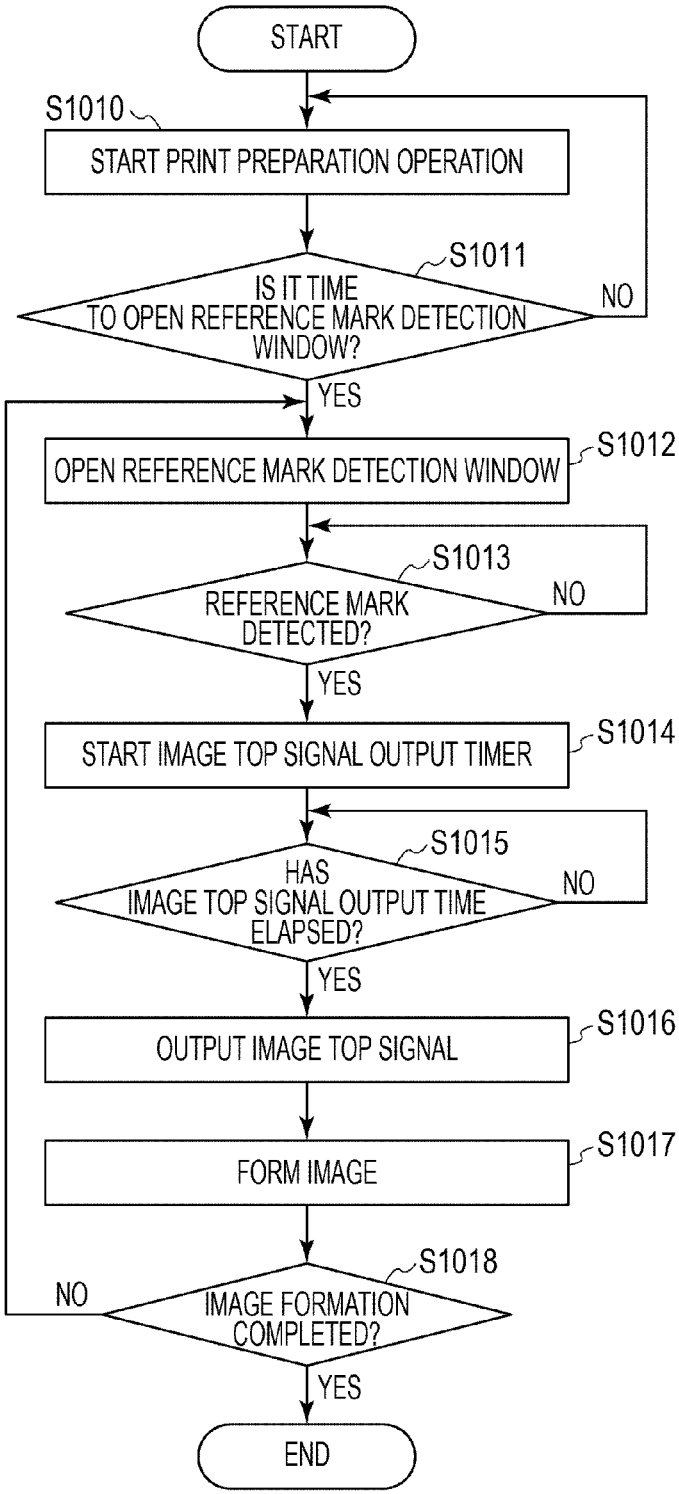
FIG. 8 is a flowchart illustrating a technique for forming an image so that a toner image is not transferred into an area including a wrinkle into which a toner image is not intended to be transferred.

FIG. 8 is a flowchart illustrating the technique for forming an image so that a toner image is not transferred into an area including a wrinkle in which a toner image is not intended to be transferred. In step S1010, upon receiving a command to start image formation from the video controller 102, the CPU 121 starts a preparation operation for image formation. The preparation operation includes starting actuators, such as the intermediate transfer belt drive motor and applying high voltages used for primary transfer control and a secondary transfer control. In step S1011, the CPU 121 determines whether it is the time to open the reference mark detection window. If it is the time to open the reference mark detection window, the CPU 121, in step S1012, opens the reference mark detection window. In step S1013, the CPU 121 continues detection until the detection sensor 70 detects the reference mark 71. If the detection sensor 70 detects the reference mark 71, the CPU 121, in step S1014, starts an image TOP signal output timer for a Y image. If, in step S1015, the image TOP signal output timer indicates that a predetermined image top signal output time has come, the CPU 121, in step S1016, outputs an image TOP signal to the video controller 102. In step S1017, the CPU 121 receives a VDO signal from the video controller 102 and forms a toner image on the basis of the VDO signal. In step S1018, as in the image formation of a Y toner image, the CPU 121 sequentially performs formation of an M toner image, a C toner image, and a Bk toner image.

Figure 9:
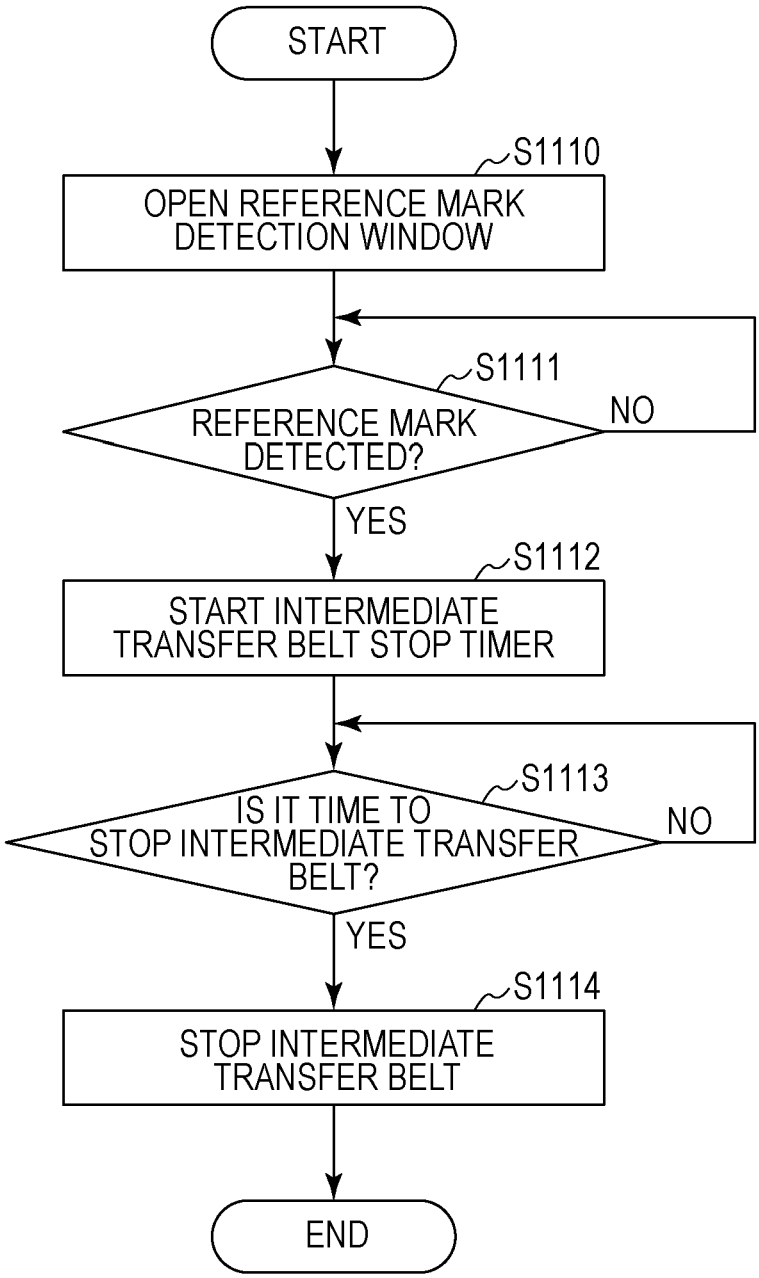
FIG. 9 is a flowchart illustrating a technique for forming a wrinkle at a predetermined position of the intermediate transfer belt.

FIG. 9 is a flowchart illustrating a technique for forming a wrinkle at a predetermined position of the intermediate transfer belt 5*a*. In step S1110, the CPU 121 opens the reference mark detection window after preparation for stopping the intermediate transfer belt 5*a* is completed. Upon detecting the reference mark 71 using the detection sensor 70 in step S1111, the CPU 121, in step S1112, starts an intermediate transfer belt stop timer. If, in step S1113, the intermediate transfer belt stop timer indicates that a preset intermediate transfer belt stop time has come, the CPU 121, in step S1114, stops driving of the intermediate transfer belt 5*a*.

In this way, the intermediate transfer belt 5*a* is stopped so that a wrinkle is formed at a predetermined position of the intermediate transfer belt 5*a* and a toner image is not transferred onto the wrinkle formed in the intermediate transfer belt 5*a* when formation of the toner image is started immediately after the preparation operation is completed by detecting the reference mark during a preparation operation for forming the image. As a result, an optimum FPOT can be realized, and the occurrence of an image defect caused by a wrinkle formed in the intermediate transfer belt 5*a* can be reduced or eliminated.

Second Embodiment

The first embodiment has been described with reference to a technique for forming an image so that a toner image does not overlap a wrinkle of the intermediate transfer belt 5*a* when an image of an A4 size is formed as an example. In a second embodiment, a control method is described for minimizing a negative impact of a wrinkle on a formed image even when a difference between the circumferential length of the intermediate transfer belt 5*a* and the size of the formed image is small and, unfortunately, a toner image is transferred onto a wrinkle of the intermediate transfer belt 5*a*. Note that since the configuration of an image forming apparatus and the structure of the intermediate transfer belt 5*a* are the same as those of the first embodiment, descriptions thereof are not repeated. For simplicity of description, description of the second embodiment is made with reference to formation of an image having a LEGAL size. However, the circumferential length of the intermediate transfer belt 5*a* and the image size are not limited thereto if a toner image needs to be transferred onto a wrinkle formed in the intermediate transfer belt 5*a*.

Figure 10:
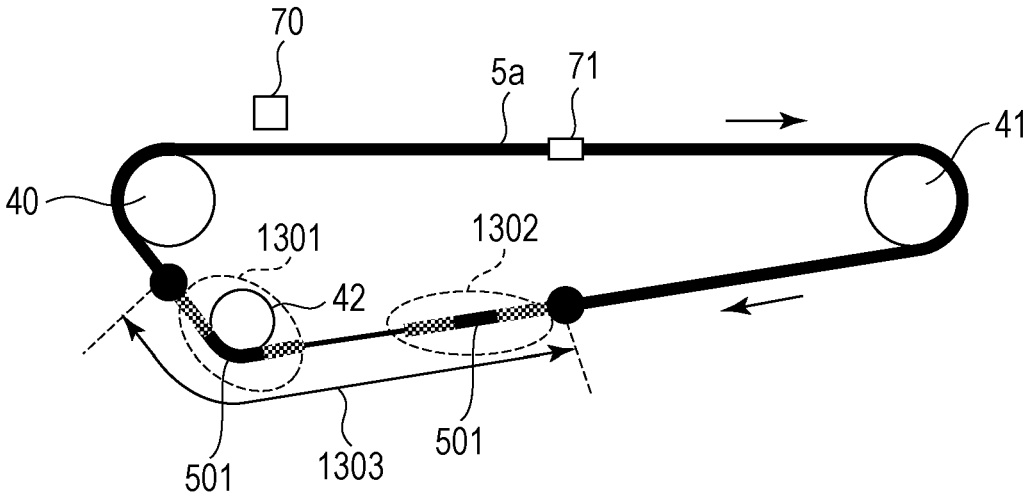
FIG. 10 illustrates an intermediate transfer belt having two stop positions.

FIG. 10 illustrates the intermediate transfer belt 5*a* having two stop positions according to the present embodiment. As illustrated in FIGS. 5A and 5B of the first embodiment, the circumferential length of the intermediate transfer belt 5*a* is set to 377 mm, and the sheet size (an image size) that is most frequently used is set to A4 (a width of 210 mm and a length of 297 mm). Then, control is performed so that an image is formed without using a wrinkle portion. Accordingly, the length of an area into which a toner image is transferred is 297 mm. The length of an area into which a toner image is not transferred is 80 mm (=377−297 mm). In addition, the length of a nip in which the intermediate transfer belt 5*a* is in contact with the support roller 42 is 15 mm, and a variation in the stop position of the intermediate transfer belt motor is 6 mm. Thus, the length of a wrinkle is 21 mm (=15 mm+6 mm). When a toner image having a LEGAL size (a width of 215.9 mm and a length of 355.6 mm) is formed under such conditions, the length of the area into which the toner image is transferred is 355.6 mm, and the length of the area into which the toner image is not intended to be transferred is 21.4 mm (=377−355.6 mm). Therefore, when a toner image of a LEGAL size is formed, it is significantly difficult to avoid the wrinkle and, thus, part of the image overlaps the wrinkle of the intermediate transfer belt 5*a*. At that time, if a wrinkle is formed at the same position, the impact of the wrinkle on an image increases. Therefore, according to the present embodiment, wrinkles are formed at a plurality of positions in the area into which a toner image is not intended to be transferred (described in the first embodiment) so as to be distributed over the intermediate transfer belt 5*a*. In this way, control is performed so that a negative impact of a wrinkle on an image is decreased. As shown in FIG. 10, in an area 1303 into which a toner image is not intended to be transferred, the intermediate transfer belt 5*a* is stopped at two positions. Thus, wrinkles are formed at two positions 1301 and 1302. Thereafter, by switching the stop position between the two positions 1301 and 1302, wrinkles are distributed. In the present embodiment, for simplicity, wrinkles are formed at two positions. However, by increasing the number of positions at which wrinkles are formed, wrinkles can be further distributed.

Figure 11:
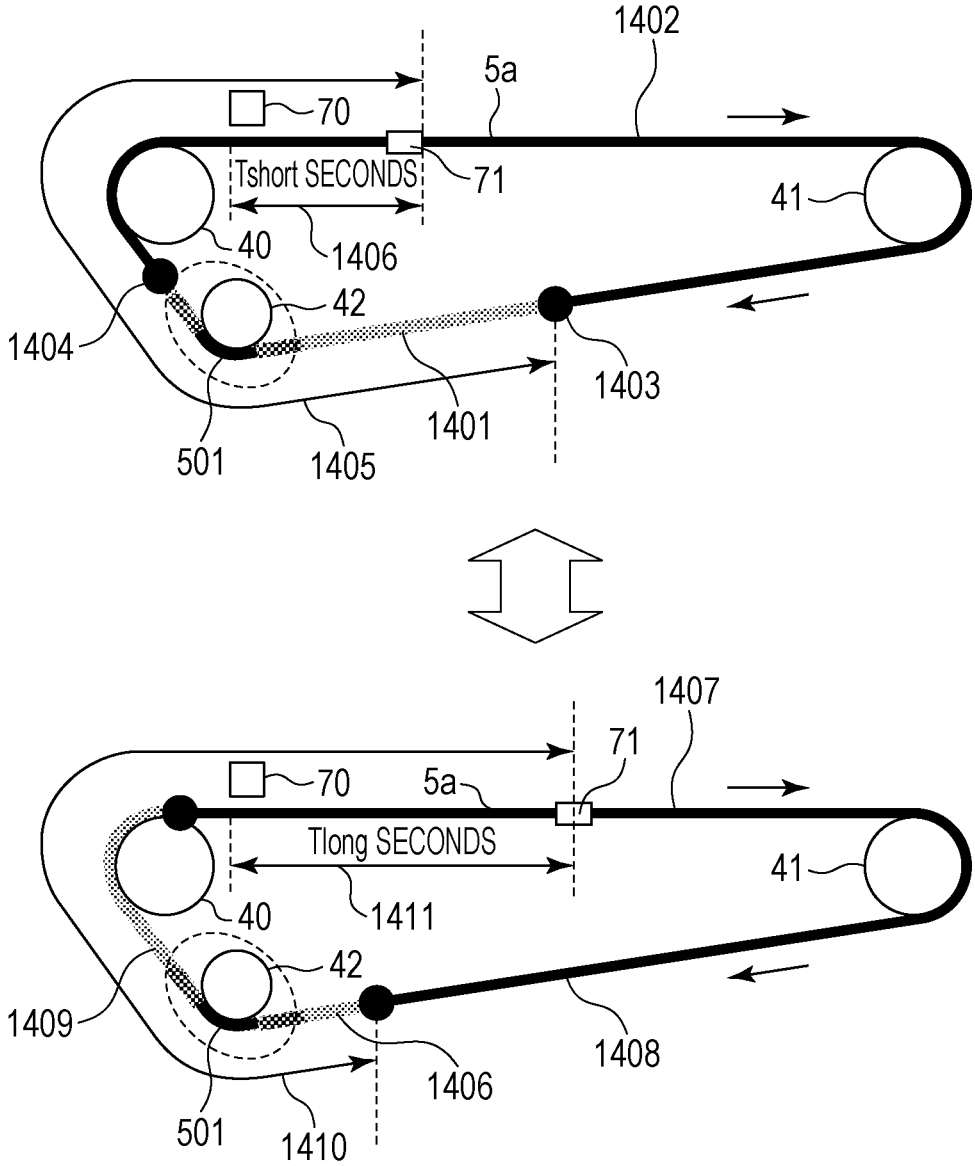
FIG. 11 illustrates two stop positions of the intermediate transfer belt.

FIG. 11 illustrates two stop positions of the intermediate transfer belt 5*a* determined in order to distribute wrinkles. In order to form a wrinkle at the leading edge 1404 of an area into which a toner image is not intended to be transferred, the intermediate transfer belt 5*a* is stopped after Tshort seconds have elapsed since the detection sensor 70 detected the reference mark 71. In contrast, in order to form a wrinkle at the trailing edge 1406 of the area into which a toner image is not intended to be transferred, the intermediate transfer belt 5*a* is stopped after Tlong seconds have elapsed since the detection sensor 70 detected the reference mark 71. Hereinafter, the stop position determined when the intermediate transfer belt 5*a* is stopped after Tlong seconds have elapsed is referred to as a "stop position 1", and the stop position determined when the intermediate transfer belt 5*a* is stopped after Tshort seconds have elapsed is referred to as a "stop position 2". In this way, by employing two stop positions, wrinkles can be distributed.

Figure 12:
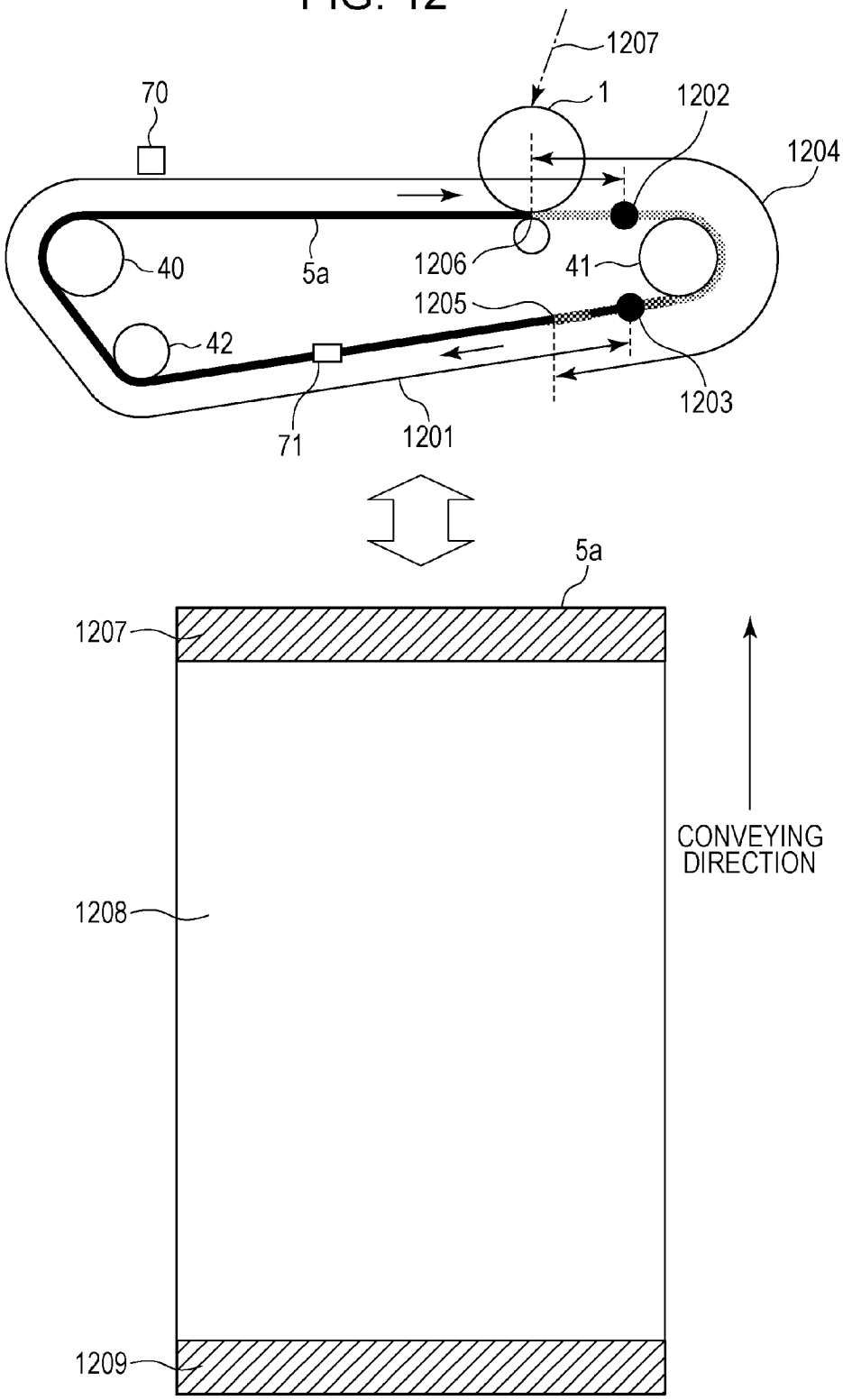
FIG. 12 illustrates the position at which a toner image having a LEGAL size is transferred.

FIG. 12 illustrates the positions of the intermediate transfer belt 5*a* having distributed wrinkles at which a toner image having a LEGAL size is transferred. The intermediate transfer belt 5*a* has an area 1204 into which a toner image having an A4 size is not transferred. The area 1204 has a leading edge 1205 and a trailing edge 1206. The intermediate transfer belt 5*a* further has an area 1201 into which a toner image having a LEGAL size is transferred. The area 1201 has a leading edge 1202 and a trailing edge 1203. When a toner image having a LEGAL size is transferred onto the intermediate transfer belt 5*a*, the toner image having a LEGAL size is transferred into even an area in which a wrinkle is formed. The toner image transferred into the wrinkle area may have an image defect due to the wrinkle. Therefore, in order to minimize a negative impact of the wrinkle on the image, according to the present embodiment, the toner image is transferred so that the leading edge and the trailing edge of the toner image overlap the wrinkle. In this manner, even when a wrinkle has a negative impact on the image, the negative impact can be minimized. More specifically, by transferring a leading edge 1207 and a trailing edge 1208 of an image area into the wrinkle area 1204, a negative impact of the wrinkles on the middle portion of the image can be prevented. In order to make the leading edge 1207 and the trailing edge 1208 overlap the wrinkle, instead of waiting for a period of time corresponding to a distance between when the reference mark 71 is detected and when the trailing edge of an area including a wrinkle in which a toner image is not intended to be transferred passes through the transfer nip, as in the first embodiment, the CPU 121 outputs an image top signal to the video controller 102 slightly earlier than that timing. This point in time is the same as the point in time when the area including a wrinkle in which a toner image is not intended to be transferred passes through the transfer nip, and transfer of the toner image starts at that time. In this way, the leading edge of the toner image overlaps the wrinkle.

Figure 13:
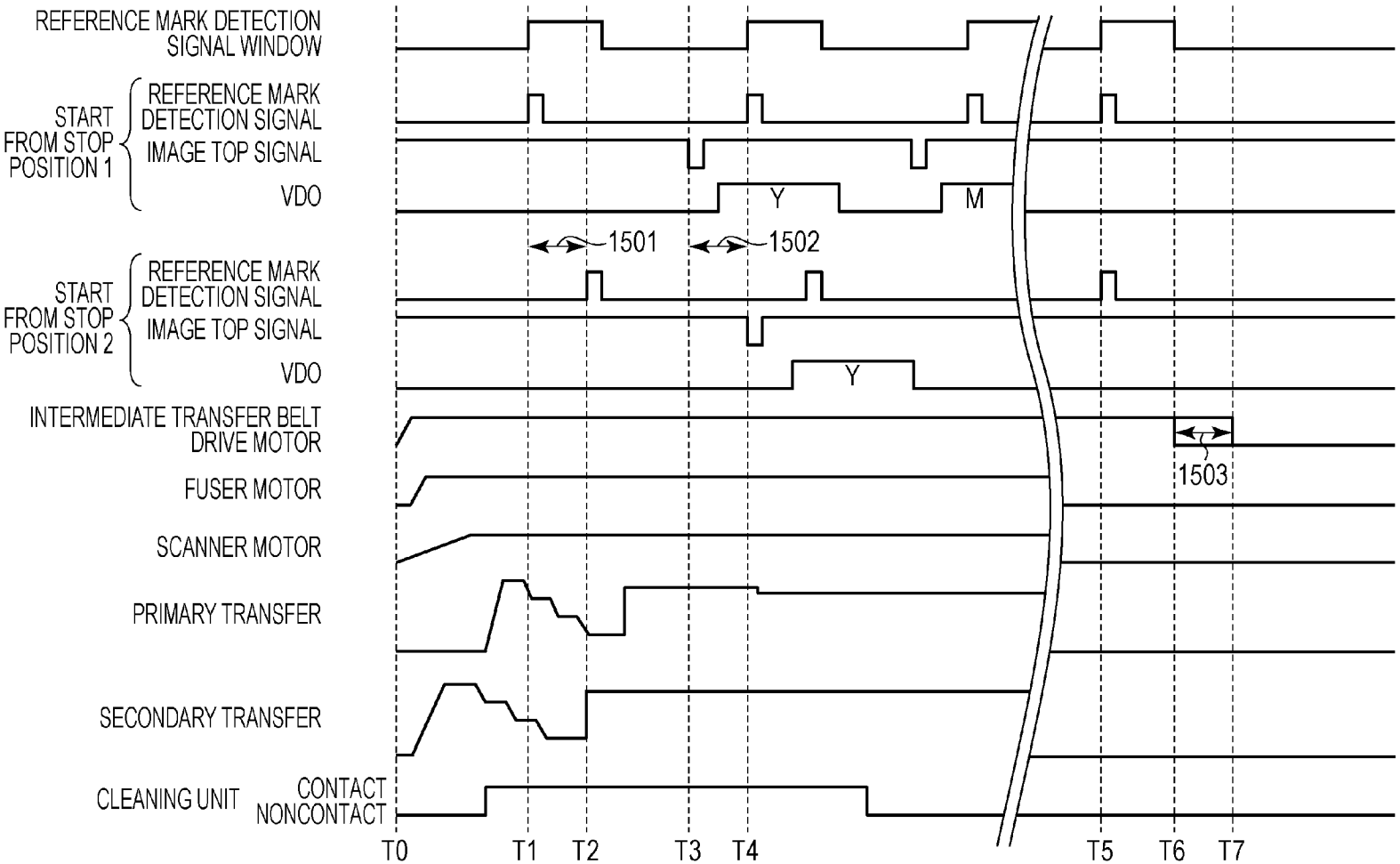
FIG. 13 is a timing diagram illustrating a preparation operation and transfer timing when two stop positions are employed.

FIG. 13 is a timing diagram illustrating a preparation operation and transfer timing when two stop positions are employed and an image having a LEGAL size is formed. A technique for reducing a negative impact of the wrinkles on a toner image even when the toner image is transferred onto the wrinkles and appropriately controlling the FPOT is described next with reference to the timing diagram. Upon receiving an image formation command, the CPU 121 starts a preparation operation before starting an image forming operation (T0). The preparation operation includes driving a variety of actuators, such as an intermediate transfer belt drive motor, a fuser motor, and a scanner motor, controlling adjustment of a secondary transfer bias, and applying a variety of high voltages. Note that the preparation operations for forming images at the stop positions 1 and 2 are the same until the reference mark detection window is opened.

At the same time as the preparation operation, in order to detect the reference mark 71 using the detection sensor 70, a monitoring operation for a reference mark is started. In order to start monitoring a reference mark, a reference mark detection window is opened, and detection continues until the detection sensor 70 detects the reference mark 71. Note that as described in the first embodiment, in order to immediately detect the reference mark 71 using the detection sensor 70 when the intermediate transfer belt 5*a* stops at the stop position 1, the position at which the intermediate transfer belt 5*a* stops is determined using the distance between the reference mark 71 and the trailing edge of an area in which a toner image is not transferred and the period of time required for the preparation operation. Accordingly, an image can be formed with an optimum FPOT without downtime after the preparation operation is completed. In contrast, when the intermediate transfer belt 5*a* is stopped at the stop position 2, the reference mark 71 is detected by the detection sensor 70 after (Tlong−Tshort) seconds have elapsed since the reference mark detection window was opened. Accordingly, a difference between the points in time at which the reference mark 71 is detected in the cases of the stop positions 1 and 2 is (T2−T1) seconds. Since the timing of outputting an image TOP signal is determined on the basis of detection of the reference mark 71, the time when the image top signal is output in the case in which image is formed from the stop position 2 is delayed from the time in the case in which image is formed from the stop position 1 by (T4−T3) seconds. In this way, since the points in time at which the image top signal is output differ for the stop positions 1 and 2, the FPOTs also differ. However, in the case of the stop position 1, the optimum FPOT that is delayed from the FPOT in the case of the stop position 2 by (T4−T3) seconds can be realized. Even when image formation is started from either the stop position 1 or the stop position 2, the FPOT can be appropriately controlled while reducing a negative impact of a wrinkle on a toner image occurring when the toner image is transferred onto the wrinkle, although the FPOT is slightly delayed from the optimum FPOT when image formation is started from the stop position 2. This is because wrinkles formed in the intermediate transfer belt 5*a* can be distributed.

The operation for stopping the intermediate transfer belt 5*a* after an image forming operation is completed is described next. After preparation for stopping the intermediate transfer belt 5*a* is completed, the CPU 121 opens the reference mark detection window and waits until the reference mark 71 is detected by the detection sensor 70. Upon detecting the reference mark 71 (T5), the CPU 121 stops the intermediate transfer belt 5*a* after Tshort seconds have elapsed when image formation is started from the stop position 1. However, the CPU 121 stops the intermediate transfer belt 5*a* after Tlong seconds have elapsed when image formation is started from the stop position 2. A difference 1503 represents a difference between Tlong seconds and Tshort seconds.

Figure 14:
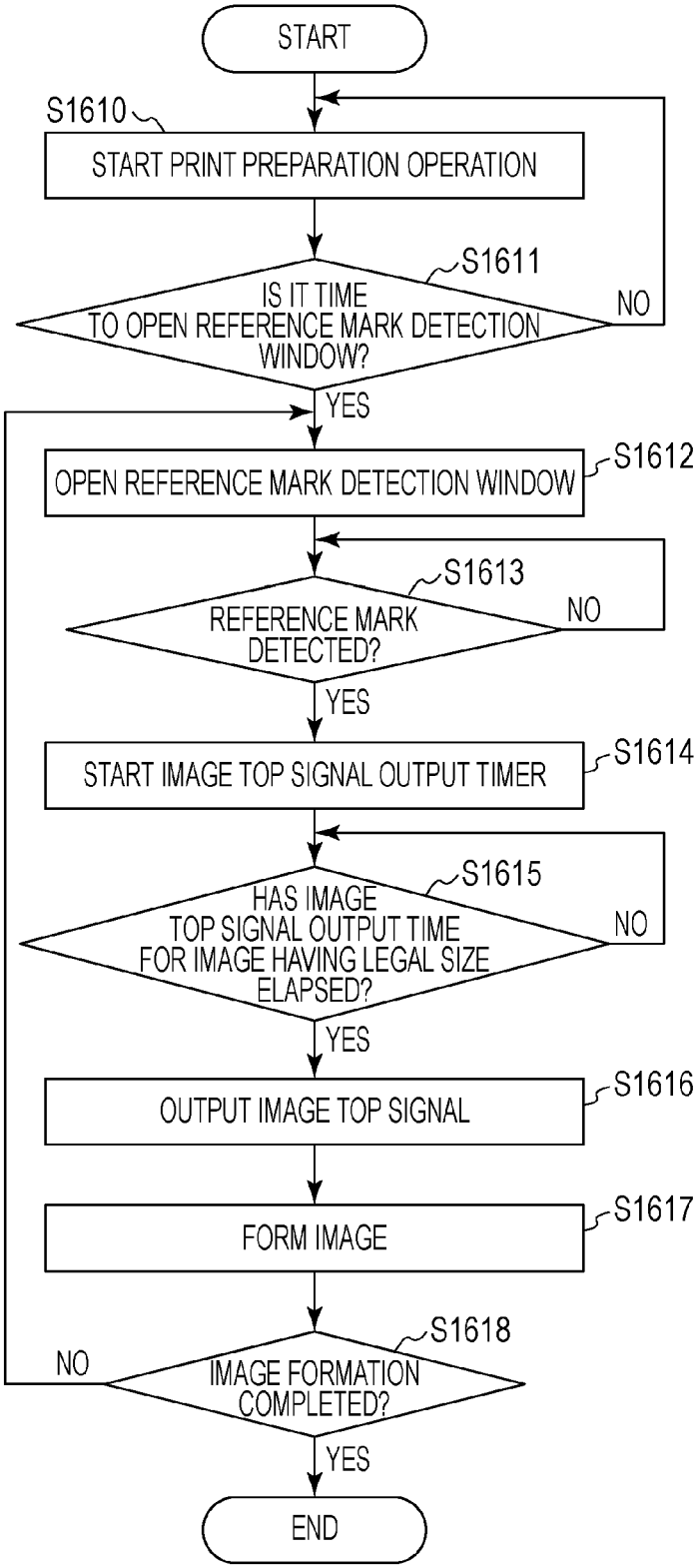
FIG. 14 is a flowchart of a technique for forming an image having a LEGAL size.

FIG. 14 is a flowchart of a technique for forming an image having a LEGAL size. In step S1610, upon receiving an image formation start command from the video controller 102, the CPU 121 starts a preparation operation before starting an image forming operation. The preparation operation includes starting actuators, such as the intermediate transfer belt drive motor and applying high voltages used for primary transfer control and secondary transfer control. In step S1611, the CPU 121 determines whether it is the time to open the reference mark detection window. If it is the time to open the reference mark detection window, the CPU 121, in step S1612, opens the reference mark detection window. In step S1613, the CPU 121 continues detection until the detection sensor 70 detects the reference mark 71. If the detection sensor 70 detects the reference mark 71, the CPU 121 starts an image TOP signal output timer for a Y image in step S1614. If, in step S1615, the image TOP signal output timer indicates that a predetermined image top signal output time for an image having a LEGAL size has come, the CPU 121, in step S1616, outputs an image TOP signal to the video controller 102. In step S1617, the CPU 121 receives a VDO signal from the video controller 102 and forms a toner image on the basis of the VDO signal. In step S1618, as in the Y image formation, the CPU 121 sequentially performs formation of an M toner image, a C toner image, and a Bk toner image.

Figure 15:
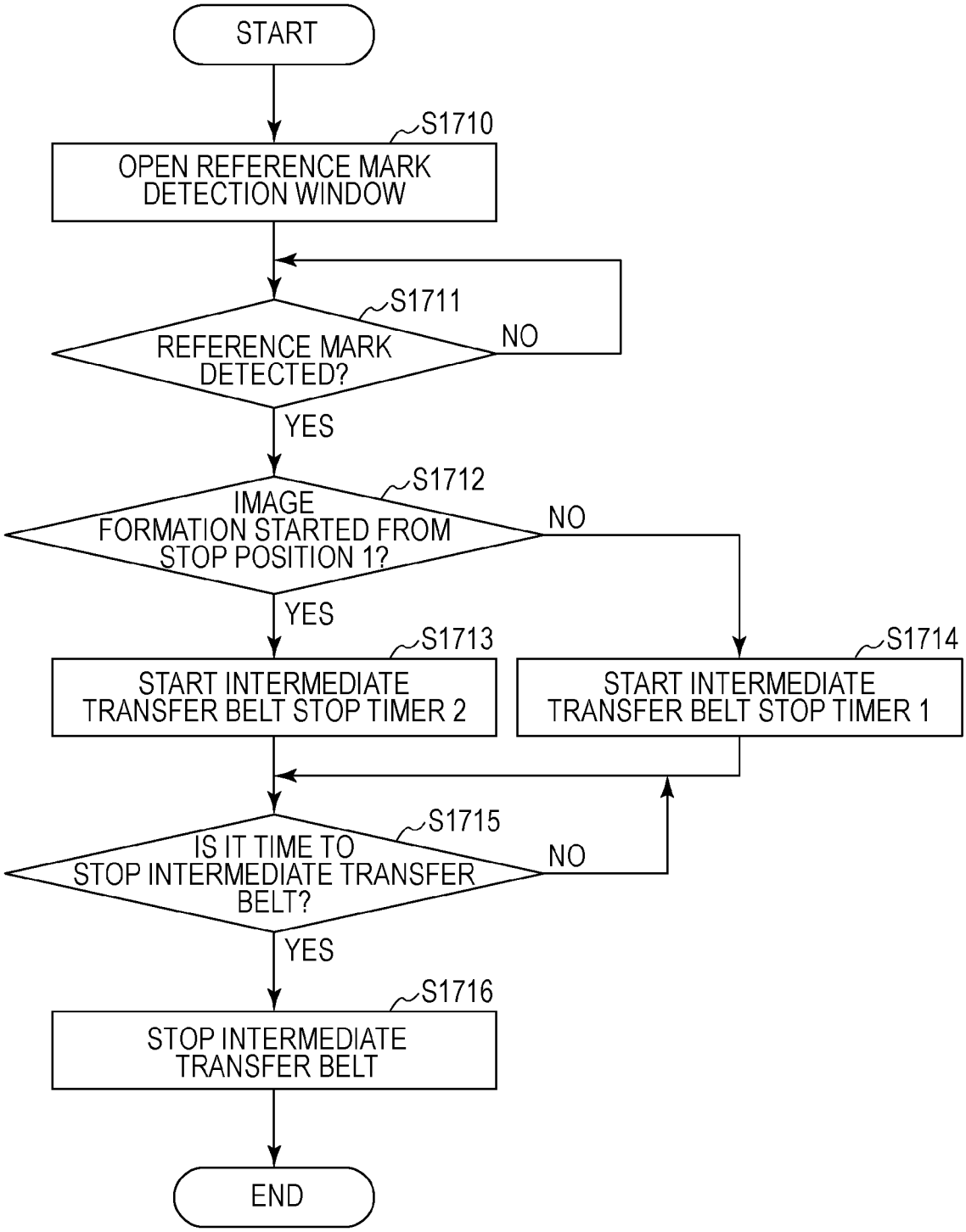
FIG. 15 is a flowchart illustrating a technique for forming wrinkles at the stop positions 1 and 2 of the intermediate transfer belt.

FIG. 15 is a flowchart illustrating a technique for forming wrinkles at the stop positions 1 and 2 of the intermediate transfer belt 5*a*. In step S1710, the CPU 121 opens the reference mark detection window after preparation for stopping the intermediate transfer belt 5*a* is completed. Upon detecting the reference mark 71 using the detection sensor 70 in step S1711, the CPU 121, in step S1712, determines whether the intermediate transfer belt 5*a* is driven from the stop position 1 in order to form an image. If the intermediate transfer belt 5*a* is driven from the stop position 1, the CPU 121, in step S1713, starts an intermediate transfer belt stop timer 2. However, if the intermediate transfer belt 5*a* is driven from the stop position 2, the CPU 121, in step S1714, starts an intermediate transfer belt stop timer 1. If, in step S1715, the intermediate transfer belt stop time has come, the CPU 121, in step S1716, stops driving of the intermediate transfer belt 5*a*.

As described above, even when a toner image having a size that is transferred into an area of the intermediate transfer belt 5*a* including a wrinkle in which a toner image is not intended to be transferred needs to be formed, control is performed so that wrinkles are formed at a plurality of positions of the intermediate transfer belt 5*a* and the leading edge and the trailing edge of the toner image overlap the wrinkle. In this way, even when a toner image is transferred onto a wrinkle, the FPOT can be appropriately controlled while reducing or eliminating a negative impact of the wrinkle on the image.

Third Embodiment

The first and second embodiments have been described with reference to the techniques for forming an image with an optimum FPOT while reducing a negative impact of the wrinkle formed in the intermediate transfer belt 5*a*. According to the present embodiment, a technique for performing control so that a patch image formed when calibration is performed is not adversely affected by a wrinkle formed in the intermediate transfer belt 5*a* is described.

Figure 16:
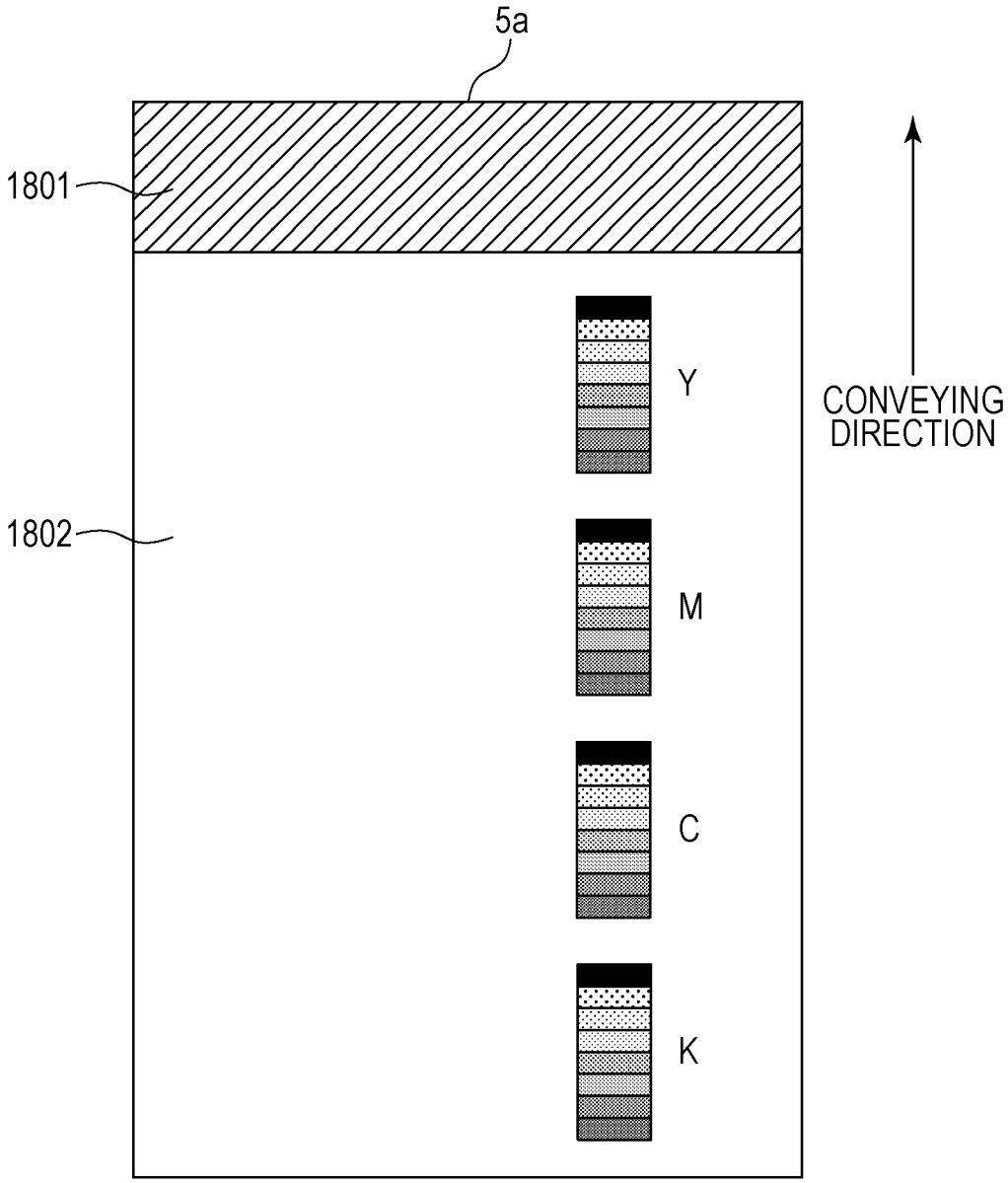
FIG. 16 illustrates a patch image used for calibration.

FIG. 16 illustrates a patch image used for calibration. An area 1801 includes a wrinkle onto which a toner image is not intended to be transferred, and a toner image is transferred into an area 1802. When calibration is performed and if a patch image is formed so as to overlap a wrinkle, a reflected light beam that generates noise may be detected by a color density sensor. Therefore, the detection accuracy may be decreased. Accordingly, a patch image is formed in the area 1802 to which a toner image is transferred without using the area 1801 to which a toner image is not intended to be transferred. In this way, the patch image is detected.

Figure 17:
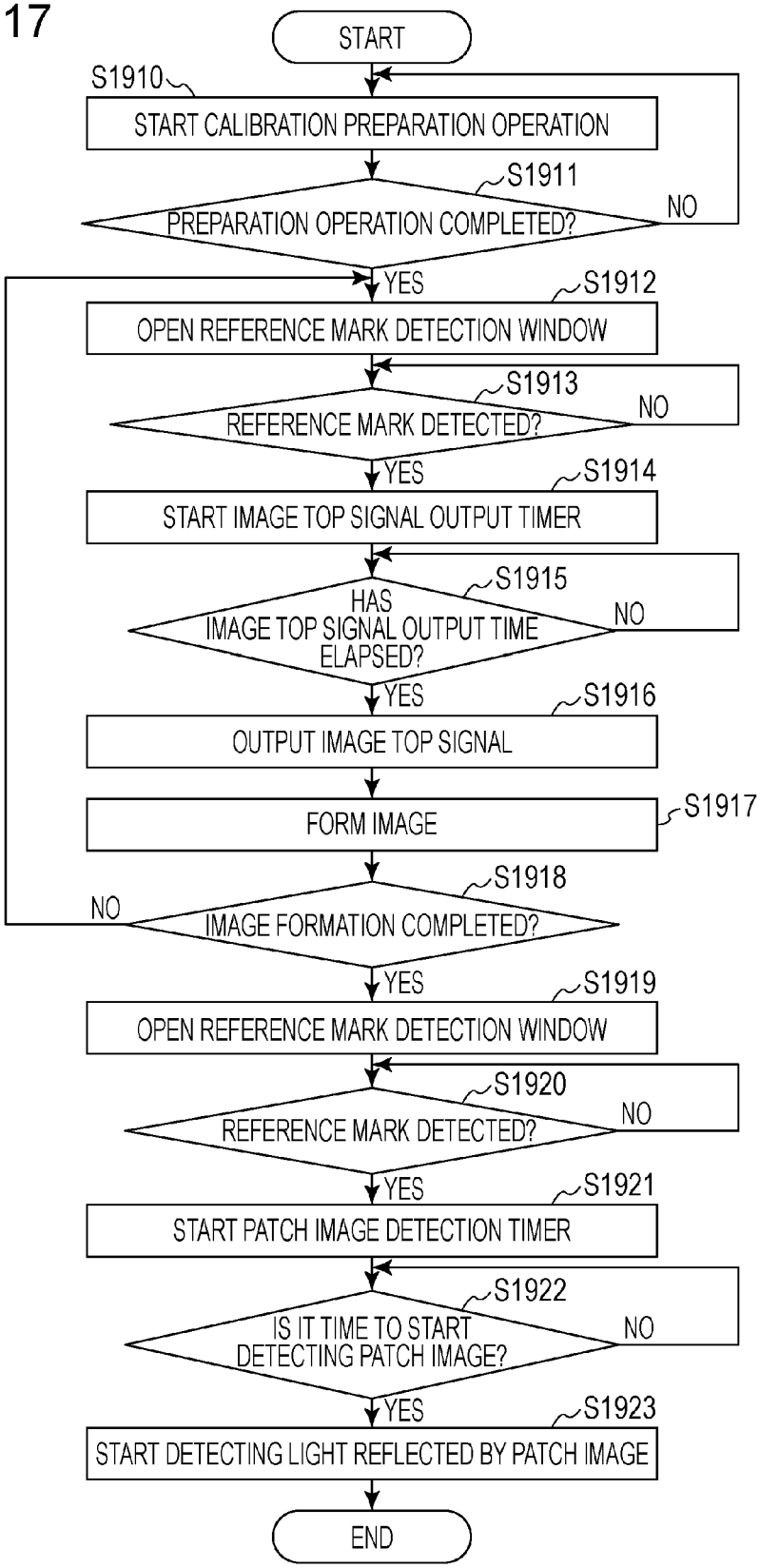
FIG. 17 is a flowchart illustrating a calibration technique.

FIG. 17 is a flowchart illustrating a calibration technique. In step S1910, upon receiving a calibration start command from the video controller 102, the CPU 121 starts a calibration preparation operation. The calibration preparation operation includes driving a variety of actuators, such as an intermediate transfer belt drive motor and applying a variety of high voltages, such as high voltage for controlling primary transfer. In step S1911, the CPU 121 determines whether the calibration preparation operation is completed. If the calibration preparation operation is completed, the CPU 121, in step S1912, opens the reference mark detection window. In step S1913, the CPU 121 continues the detecting operation until the detection sensor 70 detects the reference mark 71. If the reference mark 71 is detected by the detection sensor 70, the CPU 121, in step S1914, starts an image TOP signal output timer for a Y image. If, in step S1915, the image TOP signal output timer indicates that a predetermined image top signal output time has been reached, the CPU 121, in step S1916, outputs an image TOP signal to the video controller 102. In step S1917, the CPU 121 receives a VDO signal from the video controller 102 and forms a toner image on the basis of the VDO signal. In step S1918, the CPU 121 sequentially performs formation of an M toner image, a C toner image, and a Bk toner image in a manner similar to formation of the Y toner image.

In step S1919, the CPU 121 opens the reference mark detection window. In step S1920, the CPU 121 continues the detecting operation until the detection sensor 70 detects the reference mark 71. If the reference mark 71 is detected by the detection sensor 70, the CPU 121, in step S1921, starts a patch image detection timer. If, in step S1922, the patch image detection timer indicates that a predetermined patch image detection time has been reached, the CPU 121, in step S1923, starts detecting a light beam reflected by the patch image.

As described above, by preventing a patch image from overlapping a wrinkle formed in the intermediate transfer belt 5*a* when calibration is performed in addition to when normal image formation is performed, the patch image can be detected without being adversely affected by a wrinkle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-185088 filed Aug. 20, 2010, which is hereby incorporated by reference herein in its entirety.

What is claimed is:

1. An image forming apparatus comprising:

an image bearing member;

a developing unit configured to develop a latent image formed on the image bearing member into a toner image;

an intermediate transfer member;

a transfer unit configured to transfer the toner image formed on the image bearing member onto the intermediate transfer member at a transfer portion;

a tension member configured to support the intermediate transfer member, an imprint portion of the intermediate transfer member being formed by the tension member;

a reference mark marked on the intermediate transfer member and used for controlling the position of the intermediate transfer member;

a detecting unit configured to detect the reference mark marked on the intermediate transfer member;

a preparation unit configured to perform an initial operation when the image forming apparatus is started in order to form the toner image using the developing unit; and a control unit configured to control the transfer unit;

wherein during an initial operation performed by the preparation unit, the detecting unit detects the reference mark, and wherein the control unit performs control so that transfer of the toner image is started at a point in time after the initial operation has been completed and the reference mark has been detected during the initial operation and at which a predetermined period of time has elapsed since the reference mark was detected, where the predetermined period of time is set so that the point in time is before the reference mark is detected again after the intermediate transfer member has rotated one revolution and is after the imprint portion has passed through the transfer portion, and the transfer of the toner image ends before the imprint portion passes through the transfer portion again.

2. The image forming apparatus according to claim 1, wherein a point in time at which the reference mark is detected by the detecting unit during the initial operation performed by the preparation unit is a point in time at which image formation is started immediately after the initial operation performed by the preparation unit has been completed.

3. An image forming apparatus comprising:

an image bearing member;

a developing unit configured to develop a latent image formed on the image bearing member into a toner image;

an intermediate transfer member;

a transfer unit configured to transfer the toner image formed on the image bearing member onto the intermediate transfer member at a transfer portion;

a tension member configured to support the intermediate transfer member, an imprint portion of the intermediate transfer member being formed by the tension member;

a reference mark marked on the intermediate transfer member and used for controlling a position of the intermediate transfer member;

a detecting unit configured to detect the reference mark marked on the intermediate transfer member;

a preparation unit configured to perform an initial operation when the image forming apparatus is started in order to form the toner image using the developing unit; and a control unit configured to control the transfer unit;

wherein in order to form a first image, during an initial operation performed by the preparation unit, the detecting unit detects the reference mark, and the control unit performs control so that the transfer unit starts transfer of the toner image at a point in time after the initial operation has been completed and the reference mark has been detected during the initial operation and at which a predetermined period of time has elapsed since the reference mark was detected, where the predetermined period of time is set so that the point in time is before the reference mark is detected again after the intermediate transfer member has rotated one revolution and is after the imprint portion has passed through the transfer portion, and the transfer of the toner image ends before the imprint portion passes through the transfer portion again, and wherein in order to form a second image that is longer than the first image, during an initial operation performed by the preparation unit, the detecting unit detects the reference mark, and the control unit performs control so that the transfer unit starts transfer of the toner image at a point in time after the initial operation has been completed and the reference mark has been detected during the initial operation and at which a predetermined period of time has elapsed since the reference mark was detected, where the predetermined period of time is set so that the point in time is before the reference mark is detected again after the intermediate transfer member has rotated one revolution and is before the imprint portion passes through the transfer portion, or the transfer of the toner image ends after the imprint portion has passed through the transfer portion again.

4. The image forming apparatus according to claim 3, wherein the first image has an A4 size, and the second image has a LEGAL size.

5. The image forming apparatus according to claim 3, wherein the control unit sets a plurality of positions at each of which the imprint portion is formed in an area having a length that is the same as a difference between the length of the intermediate transfer member and the length of the first image.

6. The image forming apparatus according to claim 3, wherein when the second image is formed, the control unit controls a point in time at which a toner image is transferred onto the intermediate transfer member so that the leading edge and the trailing edge of the second image overlap the imprint portion.

* * * * *